US011454061B2

(12) United States Patent
Fujita

(10) Patent No.: US 11,454,061 B2
(45) Date of Patent: Sep. 27, 2022

(54) POWER WINDOW CONTROL DEVICE

(71) Applicant: DENSO CORPORATION, Kariya (JP)

(72) Inventor: Yuuki Fujita, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 16/956,931

(22) PCT Filed: Jan. 30, 2019

(86) PCT No.: PCT/JP2019/003091
§ 371 (c)(1),
(2) Date: Jun. 22, 2020

(87) PCT Pub. No.: WO2019/163447
PCT Pub. Date: Aug. 29, 2019

(65) Prior Publication Data

US 2020/0408027 A1 Dec. 31, 2020

(30) Foreign Application Priority Data

Feb. 21, 2018 (JP) ..... JP2018-028757

(51) Int. Cl.
*E05F 15/00* (2015.01)
*E05F 15/689* (2015.01)
*E05F 15/41* (2015.01)

(52) U.S. Cl.
CPC ..... *E05F 15/689* (2015.01); *E05F 15/41* (2015.01); *E05Y 2400/44* (2013.01);
(Continued)

(58) Field of Classification Search
CPC ..... H02H 7/0851; H02H 7/0816; E05F 15/41; E05F 15/689; E05F 15/695;
(Continued)

(56) References Cited

U.S. PATENT DOCUMENTS 6,100,658 A 8/2000 Kume et al.
6,505,127 B1 1/2003 Togami
(Continued)

FOREIGN PATENT DOCUMENTS

CN 101215947 A 7/2008
CN 108071292 A 5/2018
(Continued)

OTHER PUBLICATIONS

Mar. 19, 2019 Search Report issued in International Patent Application No. PCT/JP2019/003091.

*Primary Examiner* — Chi Q Nguyen
(74) *Attorney, Agent, or Firm* — Oliff PLC

(57) ABSTRACT

A power window control device is configured to control a motor to open and close a window glass of a vehicle door and perform entrapment prevention control that determines entrapment of foreign material by the window glass and reverses the window glass if determining that foreign material entrapment has occurred. If determined in the entrapment prevention control that the entrapment has occurred while the window glass is closing to fully close, the entrapment prevention control determines whether the determination is caused by an impact generated when closing the vehicle door. If determined that the entrapment has occurred due to an impact generated when closing the vehicle door, the entrapment prevention control determines that the determination of the entrapment is an erroneous determination and switches to a control for fully closing the window glass that has been reversed and opened.

10 Claims, 9 Drawing Sheets

(52) U.S. Cl.
CPC ... *E05Y 2400/564* (2013.01); *E05Y 2900/531* (2013.01); *E05Y 2900/55* (2013.01)

(58) Field of Classification Search
CPC ..... E05Y 2900/55; E05Y 2900/531; E05Y 2400/564; E05Y 2400/44
USPC ..... 49/26, 28, 31; 318/469, 286
See application file for complete search history.

(56) References Cited

U.S. PATENT DOCUMENTS 7,259,532 B2 * 8/2007 Shinohara ..... H02P 7/245 318/282
7,268,506 B2 * 9/2007 Nakagawa ..... H02H 7/0851 318/280
8,627,600 B2 * 1/2014 Gao ..... E05F 15/42 49/26
10,047,553 B2 * 8/2018 Shibata ..... H02P 3/08
10,337,230 B2 * 7/2019 Kigoshi ..... E05F 15/41
10,883,302 B2 * 1/2021 Sugiyama ..... E05F 15/697
11,142,940 B2 * 10/2021 Aoshima ..... E05F 15/41
11,162,293 B2 * 11/2021 Sugiyama ..... E05F 15/41
2001/0030520 A1 * 10/2001 Losey ..... G01M 15/044 318/445
2005/0276449 A1 * 12/2005 Pedemas ..... E05F 15/431 382/104
2006/0028162 A1 * 2/2006 Iwasaki ..... E05F 15/695 318/466
2006/0288642 A1 * 12/2006 Marentette ..... H02K 11/24 49/26
2006/0293821 A1 * 12/2006 Takahashi ..... H02H 7/0858 701/49
2007/0052293 A1 * 3/2007 Shibata ..... H02H 7/0851 307/10.1
2007/0236161 A1 * 10/2007 Pebre ..... H02H 7/0851 318/469
2008/0074067 A1 * 3/2008 Rhodes ..... E05F 15/431 318/280
2008/0100241 A1 * 5/2008 Takahashi ..... E05F 15/41 318/434
2009/0058340 A1 * 3/2009 Sakai ..... G05B 9/02 318/434
2017/0234051 A1 * 8/2017 Hawes ..... E05F 15/40 318/470
2019/0003238 A1 1/2019 Sugiyama et al.
2019/0071914 A1 * 3/2019 Bars ..... E05F 15/689
2019/0375277 A1 * 12/2019 Onitsuka ..... B60J 1/17
2020/0031207 A1 * 1/2020 Henes ..... B60J 1/17
2020/0149340 A1 * 5/2020 Aoshima ..... E05F 15/695

FOREIGN PATENT DOCUMENTS

JP H08-260810 A 10/1996
JP 2011-122369 A 6/2011
WO 99/42691 A1 8/1999

* cited by examiner

POWER WINDOW CONTROL DEVICE

CROSS-REFERENCE TO RELATED APPLICATIONS

The present application is based on Japanese Patent Application No. 2018-28757 filed on Feb. 21, 2018, the entire contents of which are incorporated by reference herein.

TECHNICAL FIELD

The present disclosure relates to a power window control device that has an entrapment prevention function.

BACKGROUND ART

A power window control device that controls the opening and closing of a window glass (windshield) of a vehicle door has an entrapment prevention function (refer to Patent Document 1). If foreign material is caught between the window glass and a window frame when a motor drives and closes the window glass, the entrapment prevention function reverses and opens the window glass by a predetermined amount to a position that releases the caught foreign material.

The power window control device uses a rotation detection signal of the motor to constantly monitor the rotational position and the rotation speed of the motor (opening-closing position and open-closing speed of window glass) when moving the window glass. Entrapment prevention control is executed to determine that foreign material has been caught when detecting that the rotation speed or the like of the motor has significantly changed and become less than or equal to a threshold while the window glass is closing.

PRIOR ART DOCUMENTS

Patent Documents

Patent Document 1: Japanese Laid-Open Patent Publication No. 8-260810

SUMMARY OF THE INVENTION

When a driver (occupant) parks and leaves a vehicle, the driver may wish to fully close an open window glass. Thus, the open window glass may be closed at the same time as when the vehicle door is opened and closed when the driver or the like exits the vehicle. In this case, when the vehicle door is fully closed, a great impact will be produced and transmitted to the motor inside the door. This may change the rotation speed of the motor and cause an erroneous determination that foreign material has been caught by the closing window glass. When the door is closed with a strong force and a great impact is applied in particular to the motor, an erroneous entrapment determination will easily occur.

Even if an erroneous entrapment determination is caused by the impact of the closing the door, the entrapment prevention control will determine that foreign material has been caught and reverse and open the window glass by a predetermined amount. Accordingly, if the driver or the like notices that the window glass has been non-intentionally reversed or opened by the predetermined amount, the driver will have to operate a switch again to fully close the window glass. Further, if the driver or the like does not notice that the window glass has been non-intentionally reversed or opened by the predetermined amount, the driver or the like may leave the vehicle with the window glass left open.

To cope with such a situation, an entrapment determination threshold may take into consideration the rotation speed of the motor that would be affected by the impact applied when the door is closed. However, this may lower the sensitivity of normal entrapment determination and increase the entrapment load. Thus, adjustment of the entrapment determination threshold needs to be avoided to appropriately determine entrapment.

It is an objective of the present disclosure to provide a power window control device having an entrapment prevention function that appropriately avoids erroneous entrapment determination.

According to one aspect of the present disclosure, a power window control device is configured to control a motor to open and close a window glass of a vehicle door and perform entrapment prevention control that determines entrapment of foreign material by the window glass and reverses the window glass if determining that foreign material entrapment has occurred. If determined in the entrapment prevention control that the entrapment has occurred while the window glass is closing to fully close, the entrapment prevention control determines whether the determination is caused by an impact generated when closing the vehicle door. If determined that the entrapment has occurred due to an impact generated when closing the vehicle door, the entrapment prevention control determines that the determination of the entrapment is an erroneous determination and switches to a control for fully closing the window glass that has been reversed and opened.

With the above configuration, when entrapment is determined while the window glass is being fully closed, it will be determined whether the determination that entrapment has occurred was caused by an impact generated when the vehicle door was closed. When determined that the determination that entrapment has occurred was caused by the impact of the closed vehicle door, the determination that entrapment has occurred is recognized as an erroneous determination. Accordingly, the window glass that has been reversed to open is fully closed. That is, an erroneous entrapment determination caused by an impact generated when the door is closed will not occur.

BRIEF DESCRIPTION OF THE DRAWINGS

The above object and other objects, features, and advantages of the present disclosure will become more apparent from the following detailed description with reference to the accompanying drawings.

DETAILED DESCRIPTION OF THE DRAWINGS

First Embodiment

A power window control device according to a first embodiment will now be described.

Figure 1:
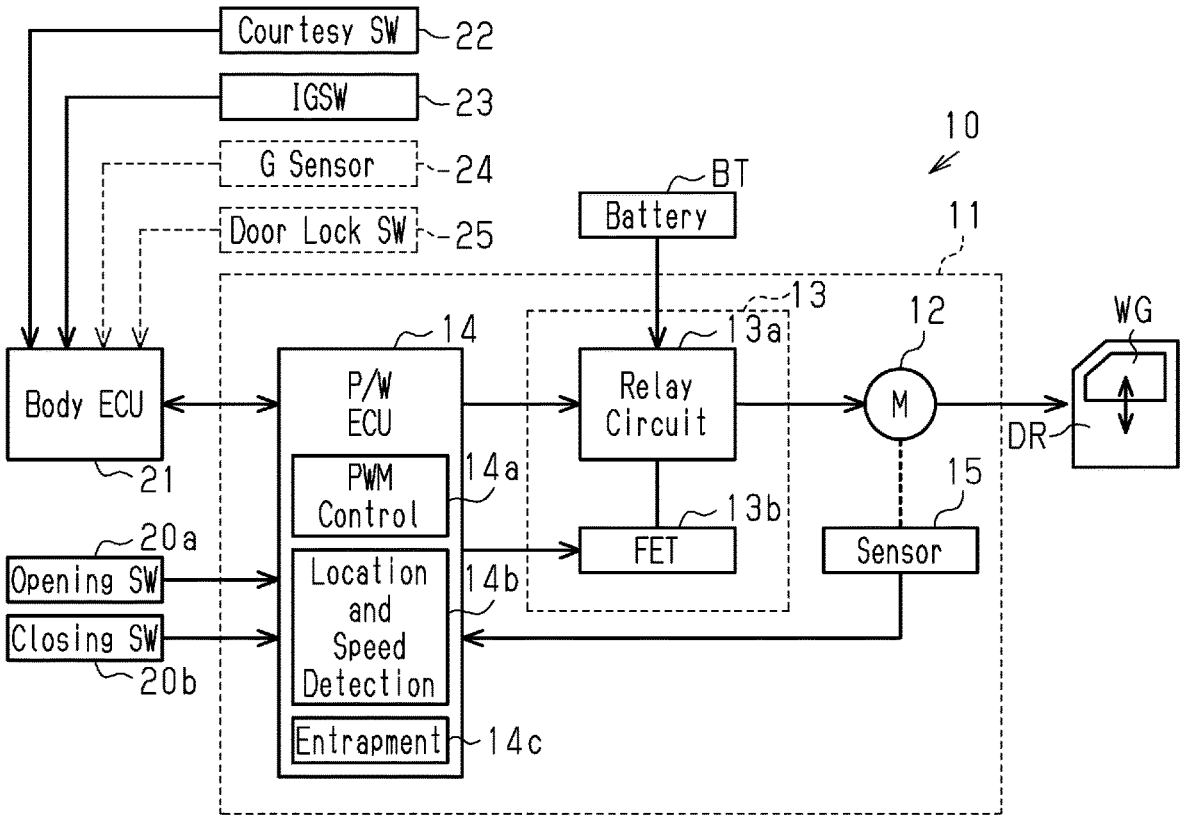
FIG. 1 is a schematic diagram showing the configuration of a power window system according to first to fourth embodiments.

As shown in FIG. 1, a power window system 10 installed in a vehicle includes a power window motor 11 and a body electronic control unit (ECU) 21. The power window motor 11, which is attached to the inside of each vehicle door DR, serves as a drive source that opens and closes a window glass WG (windshield) of a vehicle door DR. The ECU 21 is connected to the motor 11 of the door DR in a manner allowing for communication.

The motor 11 is configured by integrally coupling a motor body 12, a drive circuit 13, and a power window ECU (P/W ECU) 14 serving as the power window control device.

The motor body 12, which is driven and rotated based on drive power from the drive circuit 13, opens and closes the window glass WG in the vertical direction with a window regulator (not shown).

The drive circuit 13 includes a relay circuit 13*a* and a field effect transistor (FET) 13*b*. The relay circuit 13*a* is supplied with power from an onboard battery BT to supply and stop drive power that drives the motor body 12 to produce forward or reverse rotation. The FET13*b*, which serves as a semiconductor switching element, undergoes pulse width modulation (PWM) control and adjusts drive power that is output from the relay circuit 13*a*. In other words, the relay circuit 13*a* drives the motor body 12 to produce forward rotation or reverse rotation or stops driving the motor body 12. That is, the relay circuit 13 moves the window glass WG in the opening or closing direction or stops moving the window glass WG. The FET13*b* changes the rotation speed of the motor body 12. That is, the FET 13*b* changes the moving speed of the window glass WG. The relay circuit 13*a* and the FET13*b* are controlled by the P/W ECU 14.

The P/W ECU 14 includes a PWM controller 14*a*, a location and speed detector 14*b*, and an entrapment processor 14*c*. The P/W ECU 14 performs various types of control related to the opening and closing of the window glass WG using the PWM controller 14*a*, the location and speed detector 14*b*, the entrapment processor 14*c*, and the like. When performing the various types of control, the P/W ECU 14 receives rotation pulse signals that are synchronized with the rotation of the motor body 12 from a rotation sensor 15. The P/W ECU 14 also receives an opening or closing instruction signal from opening and closing switches (opening SW and closing SW) 20*a*, 20*b* on the vehicle door DR or the like.

The P/W ECU 14 switches (ON) the relay circuit 13*a* to allow power to be supplied in a power supplying direction that rotates, for example, the motor body 12 forward when an opening instruction signal is input and in a power supplying direction that reverse rotation of the motor body 12 when a closing instruction signal is input. In this case, the PWM controller 14*a* of the P/W ECU 14 outputs a PWN control signal to a control terminal of the FET13*b* and switches the FET13*b* between fixed ON (duty 100%) and ON-OFF driving (duty variable) at a predetermined frequency. If an opening and closing instruction signal input is no longer input, the P/W ECU 14 stops (OFF) supplying power to the motor body 12 with the relay circuit 13*a*, and the PWM controller 14*a* switches off the FET13*b* OFF with a PWN control signal.

The location and speed detector 14*b* detects the rotational position of the motor body 12, namely, the position of the window glass WG from rotation pulse signals that are synchronized with the rotation of the motor body 12, specifically, the edge count of the pulse signals. The positional information of the window glass WG is constantly stored in a memory (not shown) inside the P/W ECU 14. The location and speed detector 14*b* also detects the rotation speed of the motor body 12 (moving speed of window glass WG) from rotation pulse signals, specifically, the length of the cycle of pulse signals. The cycle of the rotation pulse signals is lengthened as the rotation speed of the motor body 12 decreases.

The entrapment processor 14*c* determines entrapment of foreign material between the closing window glass WG and the vehicle door DR when the rotation speed (or amount of change in rotation speed) of the motor body 12 closing the window glass WG is greatly decreased to less than or equal to a threshold value. If the entrapment processor 14*c* determines that entrapment has occurred, the entrapment processor 14*c* controls the relay circuit 13*a* and the FET13*b* to open (reverse) the window glass WG by a predetermined amount to allow the entrapped foreign material to be released.

The P/W ECU 14 is connected by a vehicle communication system to a body ECU 21, which serves as an upper rank ECU, in a manner allowing for communication. The vehicle communication system may be a local interconnect network (LIN) or a controller area network (CAN). The P/W ECU 14 obtains various types of necessary vehicle information from the body ECU 21. In the present embodiment, the P/W ECU 14 obtains, through the body ECU 21, a door opening and closing signal of a courtesy switch (courtesy SW) 22, which detects an open and closed position of the vehicle door DR, and an IG state signal of an ignition switch (IG SW) 23.

Power window control according to the present embodiment will now be described. Control, when the vehicle door DR is closing at the same time as when the window glass WG is closing, will now be described with reference to the flowchart of FIG. 2A and the timing chart of FIG. 2B.

When the IG SW 23 is switched OFF by a driver or the like, the P/W ECU 14 (entrapment processor 14*c*) proceeds from step S11 to step S12 and determines whether the closing SW 20*b* is switched ON within, for example, 60[s] (seconds). In this case, an automatic closing (full closing) SW in the closing SW 20*b* is switched ON. If the closing SW 20*b* has not been switched ON within 60[s], the process ends. If the closing SW 20*b* (automatic closing) is switched ON within 60[s], the P/W ECU 14 proceeds to step S13 and drives the motor body 12 to close the window glass WG.

Then, the P/W ECU 14 proceeds to step S14 and monitors the signal of the courtesy SW 22 that detects the open and closed position of the door DR. That is, during the closing action of the window glass WG, the P/W ECU 14 detects whether the signal of the courtesy SW 22 has changed from ON to OFF, that is, whether the door DR has been moved from an open position to a closed position.

In step S15, the P/W ECU 14 determines whether foreign material is entrapped by the closing window glass WG. If there is no entrapment, the process ends. If the P/W ECU 14 determines that there is entrapment, the P/W ECU 14 proceeds to step S16 and drives the motor body 12 so that the window glass WG is reversed and opened by a predetermined amount.

The P/W ECU 14 proceeds to step S17 and determines whether the determination that entrapment has occurred in step S15 was an erroneous determination and the reversing action of the window glass WG was an erroneous reversal. In other words, the P/W ECU 14 determines whether the determination that entrapment has occurred in step S15 was caused by the closing door DR. Specifically, during a predetermined time x[s] prior to the determination that entrapment has occurred (period during which erroneous entrapment determination may occur due to effect of impact generated by closing door DR), the P/W ECU 14 monitors the signal of the courtesy SW 22 in step S14 and determines whether the signal was switched to ON (open door DR was closed), that is, whether an impact was generated by the closing door DR to determine that the closing of the door DR caused an erroneous entrapment determination and erroneously reversed the window glass WG.

In step S17, if the P/W ECU 14 determines that the determination that entrapment has occurred was not an erroneous determination and the window glass WG was not erroneously reversed (normal reversing action was performed), the process ends. If the P/W ECU 14 determines that the determination that entrapment has occurred was an erroneous determination and the window glass WG was erroneously reversed, the P/W ECU 14 determines that the determination that entrapment has occurred was caused by the impact generated when the door DR was closed. Accordingly, the P/W ECU 14 proceeds to step S18 and shifts to a full closing mode. That is, the P/W ECU 14 drives the motor body 12 to fully close the window glass WG, which has been opened in an unexpected manner due to the erroneous determination. When the window glass WG is fully closed, the process ends.

The present embodiment eliminates the need for the driver or the like to operate the closing SW 20*b* again to fully close the window glass WG when an impact generated by the closed door DR causes an erroneous entrapment determination (erroneous reversal of window glass WG) in an unexpected manner. The present embodiment also prevents the window glass WG from remaining open when the driver or the like leaves the vehicle. In the present embodiment, in steps S11 and S12, the process advances when the closing SW 20*b* is switched ON within, for example, 60[s] from when the IG SW 23 is switched OFF. The control is configured under the assumption that when leaving the parked vehicle, the driver or the like will open and close the door DR to exit the vehicle while simultaneously closing the open window glass WG.

The advantages of the present embodiment will now be described.

(1) When entrapment is determined while the window glass WG is being fully closed, it will be determined whether the determination that entrapment has occurred was caused by an impact generated when the vehicle door DR was closed. When determined that the determination that entrapment has occurred was caused by the impact of the closed vehicle door DR, the determination that entrapment has occurred is recognized as an erroneous determination. Accordingly, the window glass WG that has been reversed to open is fully closed. That is, an erroneous entrapment determination caused by an impact generated when the door DR is closed will not occur.

(2) The courtesy SW 22 allows for detection of closing of the door DR, which is when an impact may be generated. Further, the courtesy SW 22 is usually installed in a vehicle. This allows a simple configuration to detect an erroneous entrapment determination that would be caused by an impact generated when the door DR is closed.

(3) The window glass WG will automatically start to fully close if erroneous entrapment determination has reversed and opened the window glass WG. This does not require the driver or the like to perform an additional operation.

(4) If full closing of the window glass WG is started within a preset time (60 [s] in present embodiment) from when the IG SW 23 is switched OFF, it is determined whether the determination that entrapment has occurred is erroneous. When the IG SW 23 is switched off and the driver or the like leaves the parked vehicle, during the period assumed that the closing of the window glass WG would be performed simultaneously with the opening and closing of the door DR, an impact generated by the closed door DR would easily cause an erroneous entrapment determination. Thus, if the determination that entrapment has occurred is determined within a preset time from when the IG SW 23 is switched OFF, it is determined that the entrapment determination is erroneous. This will eliminate the need for unnecessary processes to determine whether the determination that entrapment has occurred is erroneous. Further, the IG SW 23 is usually installed in a vehicle. Thus, such determination may be performed with a simple configuration.

Second Embodiment

A power window control device according to a second embodiment will now be described.

Figure 3A:
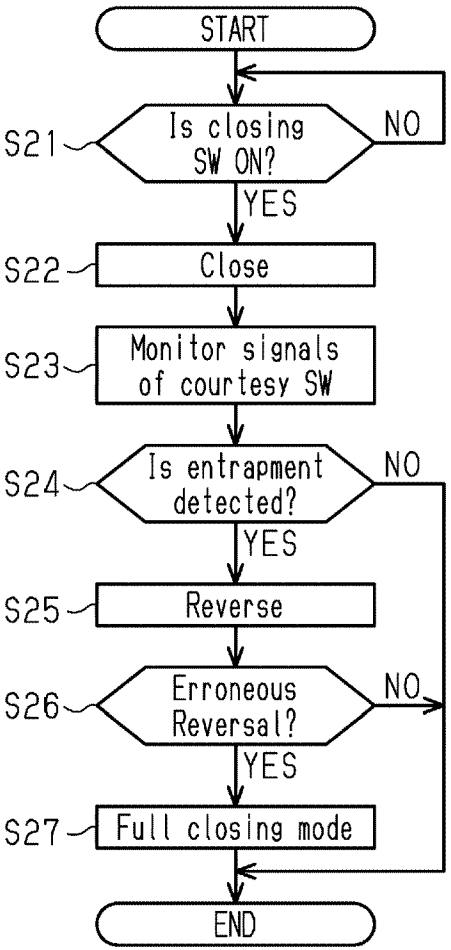
FIG. 3A is a flowchart showing a power window control mode according to the second embodiment.
Figure 3B:
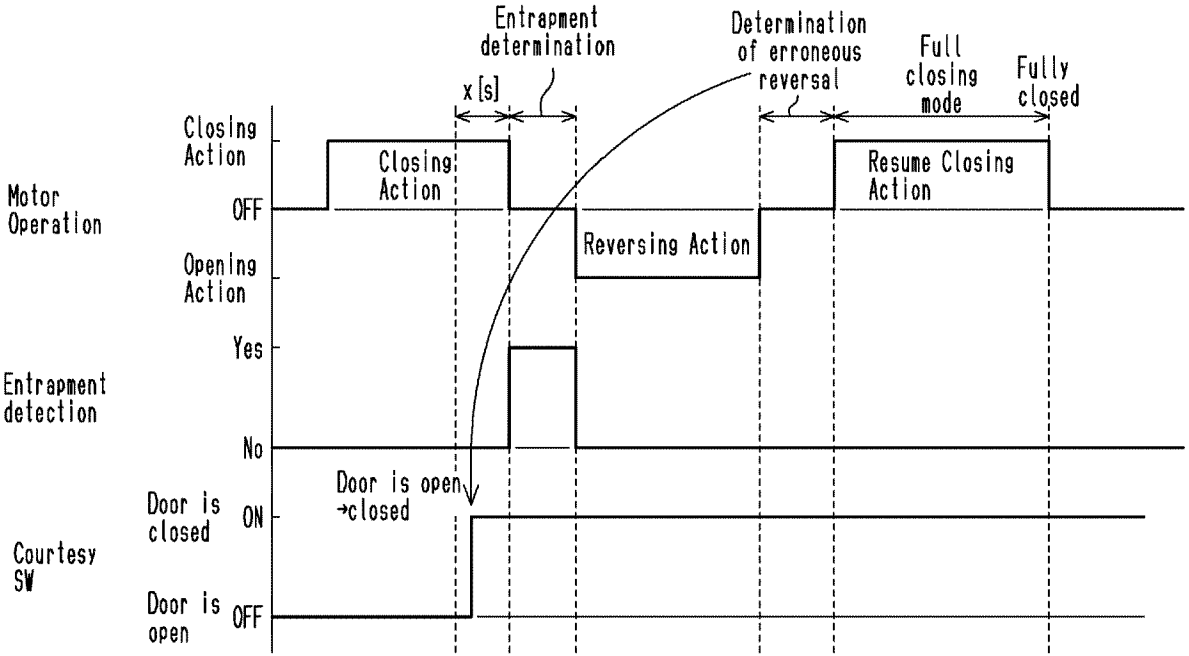
FIG. 3B is a timing chart of the power window control mode according to the second embodiment.

Control according to the present embodiment is applied to the power window system 10 shown in FIG. 1. The control is illustrated in detail in the flowchart of FIG. 3A and the timing chart of FIG. 3B. The control of the present embodiment differs from the first embodiment in that only the signal of the courtesy SW 22 is used (signal of IG SW 23 is not used).

Figure 2A:
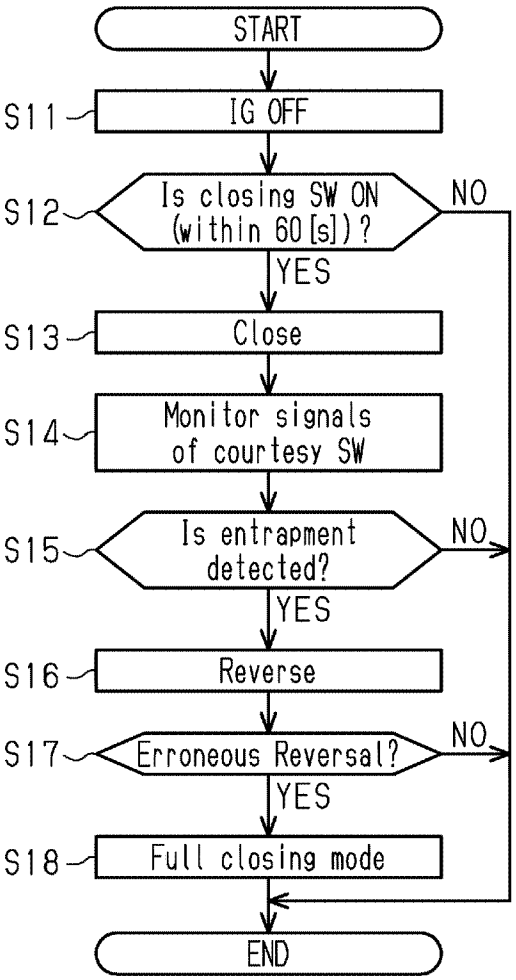
FIG. 2A is a flowchart showing a power window control mode according to the first embodiment.
Figure 2B:
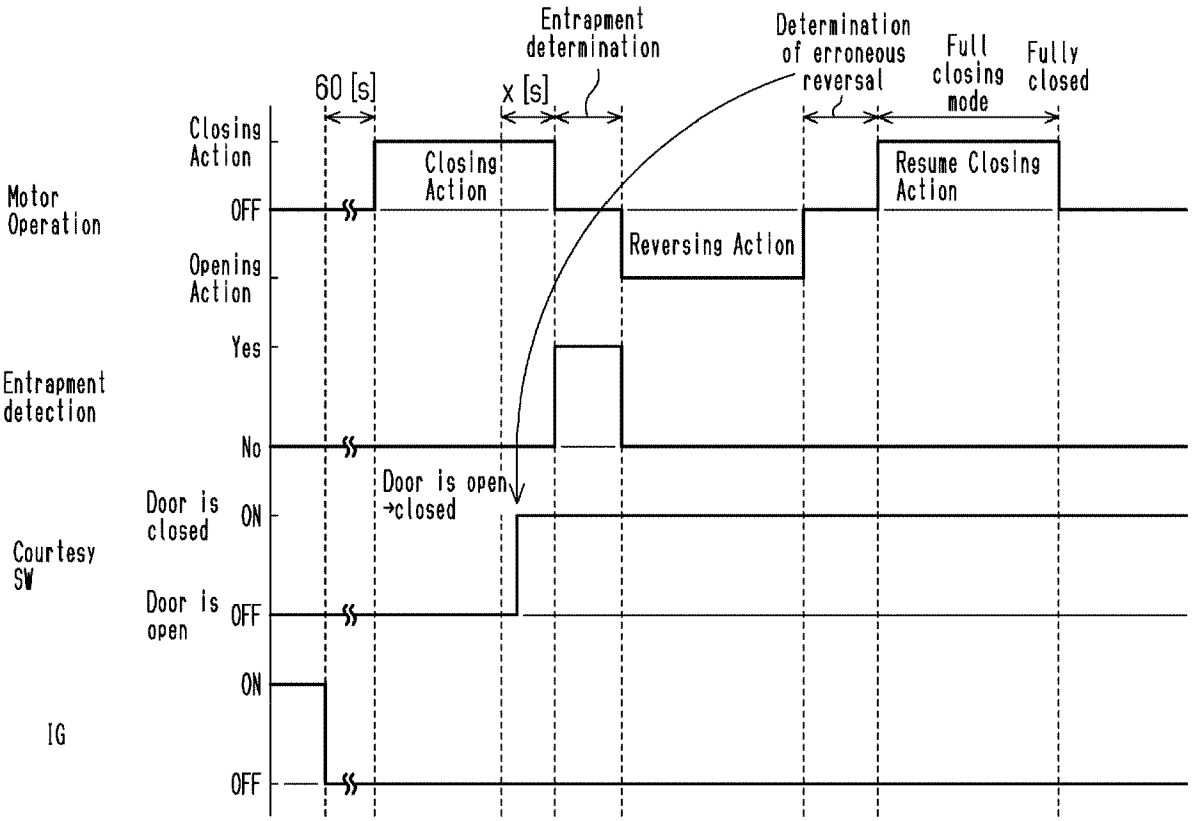
FIG. 2B is a timing chart of the power window control mode according to the first embodiment.

The process flow of the P/W ECU 14 in the present embodiment starts from step S21 based on the closing SW 20*b* (detection of ON/OFF of automatic closing SW in closing SW 20*b*), and following steps S22 to S27 are the same as steps S13 to S18 of the first embodiment (refer to FIG. 2A).

The present embodiment eliminates the need for the driver or the like to operate the closing SW 20*b* again to fully close the window glass WG that is opened in an unexpected manner due to an erroneous entrapment determination (erroneous reversal of window glass WG) caused by an impact generated when the door DR is closed. The present embodiment also prevents the window glass WG from being left open when the driver or the like leaves the vehicle.

The advantages of the present embodiment will now be described.

(1) The present embodiment has advantage (1) of the first embodiment.

(2) The present embodiment has advantage (2) of the first embodiment.

(3) The present embodiment has advantage (3) of the first embodiment.

Third Embodiment

A power window control device according to a third embodiment will now be described.

Figure 4A:
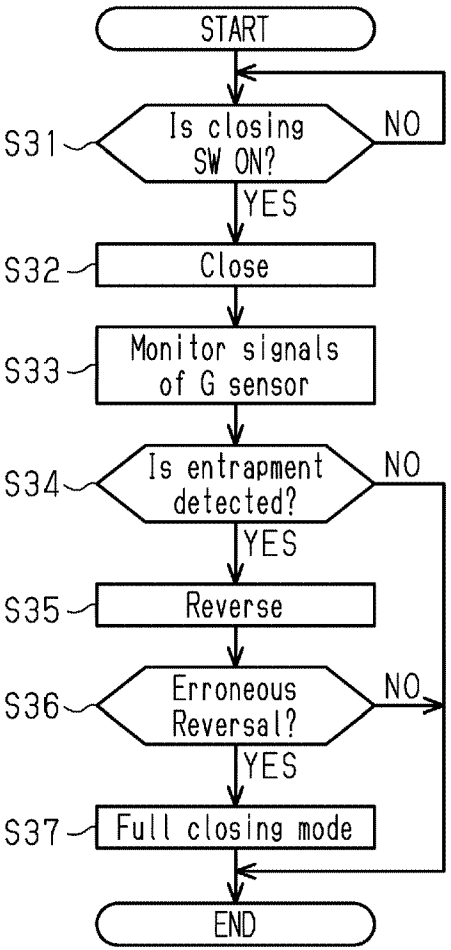
FIG. 4A is a flowchart showing a power window control mode according to the third embodiment.
Figure 4B:
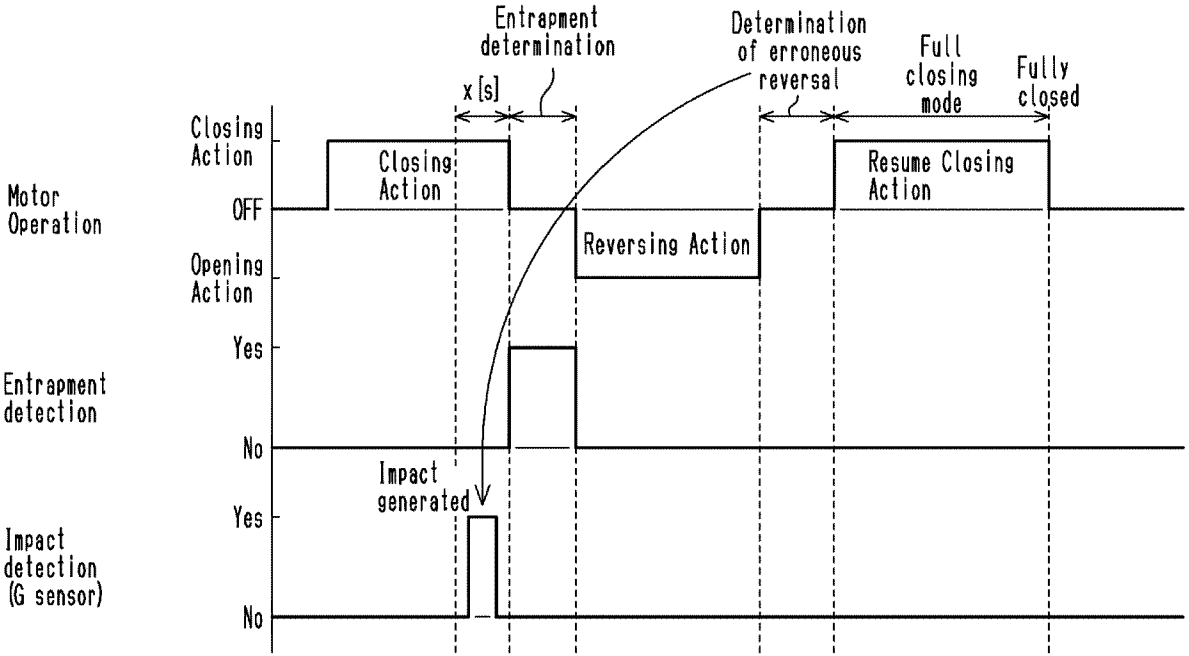
FIG. 4B is a timing chart of the power window control mode according to the third embodiment.

Control according to the present embodiment is applied to the power window system 10 shown in FIG. 1. The control is illustrated in detail in the flowchart of FIG. 4A and the timing chart of FIG. 4B. The control of the present embodiment differs from the second embodiment in that a signal of an acceleration sensor (G sensor) 24 shown in FIG. 1 is used. The P/W ECU 14 in the present embodiment obtains, through the body ECU 21, an acceleration signal of the G sensor 24 that detects acceleration acting on the vehicle in a predetermined direction. In other words, the P/W ECU 14 detects, through the acceleration signal, an impact generated when opening and closing of the vehicle door DR, in particular, when closing the vehicle door DR (impact that is greater than or equal to threshold value of entrapment determination and affects entrapment determination).

In the process flow of the P/W ECU 14 in the present embodiment, steps S31 to S37 are substantially the same as steps S21 to S27 of the second embodiment except in that step S23 based on a signal of the courtesy SW 22 in the second embodiment (refer to FIG. 3A) is replaced by step S33 based on a signal of the G sensor 24 (monitoring of signal of G sensor 24). In other words, the G sensor 24 is used in the present embodiment so that the impact generated when the door DR is closed can be detected in the same manner as the courtesy SW 22 of the second embodiment. In step S36, the P/W ECU 14 determines whether an impact was generated when the door DR was closed by monitoring the signal of the G sensor 24 in step S33 during time x[s] prior to entrapment determination (period in which effect of impact of closed door DR causes erroneous entrapment determination) to determine that the entrapment determination was erroneous and caused by the closed door DR and that the window glass WG was erroneously reversed.

The present embodiment eliminates the need for the driver or the like to operate the closing SW 20*b* again to fully close the window glass WG that is opened in an unexpected manner due to an erroneous entrapment determination (erroneous reversal of window glass WG) caused by an impact generated when the door DR is closed. The present embodiment also prevents the window glass WG from being left open when the driver or the like leaves the vehicle.

The advantages of the present embodiment will now be described.

(1) The present embodiment has advantage (1) of the second embodiment.

(2) The G sensor 24 detects an impact when the door DR is closed, and the G sensor 24 is usually installed in a vehicle. This allows an erroneous entrapment determination caused by the impact generated when the door DR is closed to be detected with a simple configuration.

(3) The present embodiment has advantages (3) of the second embodiment.

Fourth Embodiment

A power window control device according to a fourth embodiment will now be described.

Figure 5B:
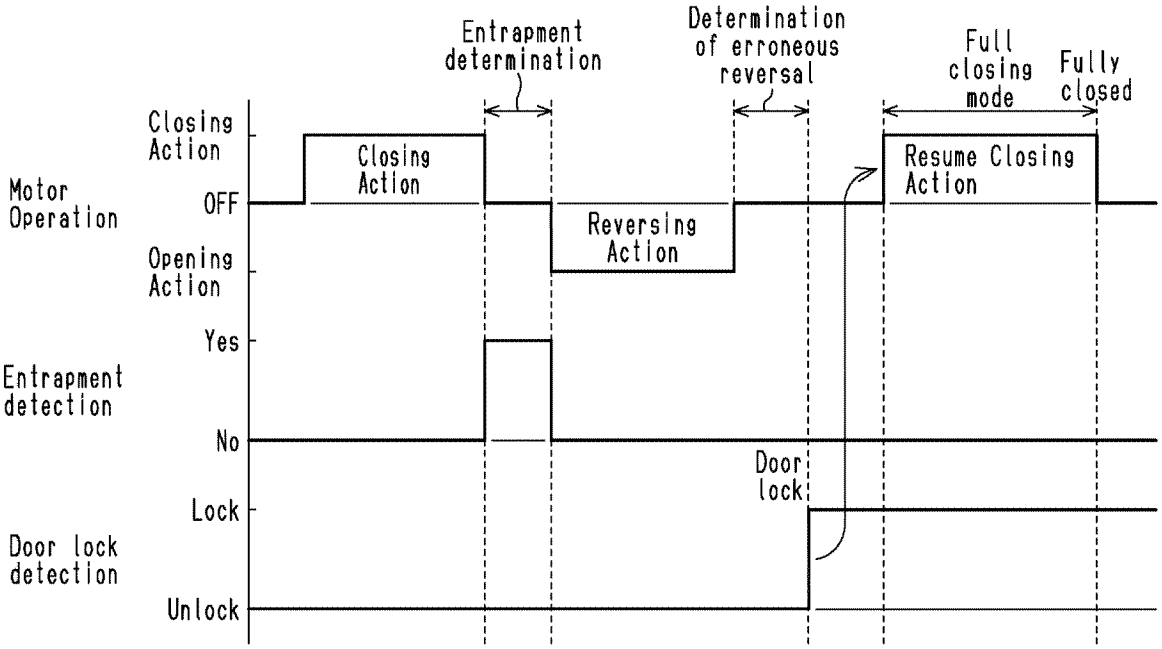
FIG. 5B is a timing chart of a power window control mode according to the fourth embodiment.

Control according to the present embodiment is applied to the power window system 10 shown in FIG. 1. The control is illustrated in detail in the flowchart of FIG. 5A and the timing chart of FIG. 5B. The control in the present embodiment differs from the third embodiment in that a signal of a door lock switch (door lock SW) 25 shown in FIG. 1 is remotely operated by a portable key or the like. The P/W ECU 14 in the present embodiment obtains, through the body ECU 21, a lock instruction signal of the door lock SW 25 that detects a lock instruction when the vehicle door DR is closed.

The process flow of the P/W ECU 14 in the present embodiment includes step S46 based on a signal of the door lock SW 25 between step S45 that determines erroneous reversal of the window glass WG resulting from an erroneous entrapment determination of and step S47 that shifts the window glass WG to a full closing mode. The process in the third embodiment fully closes the window glass WG automatically after determining that the window glass WG has been erroneously reversed. However, the process in the present embodiment fully closes the window glass WG based on a lock instruction from the door lock SW 25, which can be remotely operated, that is, based on the intention of the driver and the like subsequent to determination that the window glass WG has been erroneously reversed.

Figure 5A:
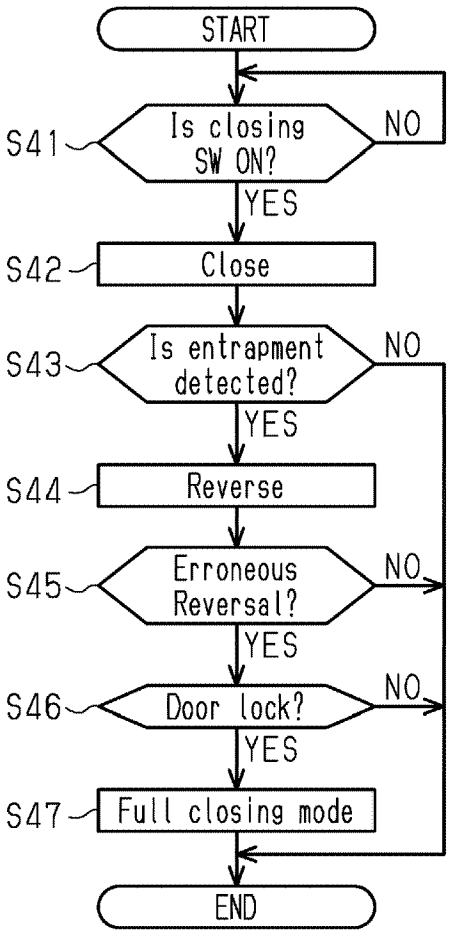
FIG. 5A is a flowchart showing a power window control mode according to the fourth embodiment.

The process flow in the present embodiment shown in FIG. 5A does not illustrate step S33 (not shown) that is based on a signal of the G sensor 24 in the third embodiment (refer to FIG. 4A) and included between step S42 and step S43. In this case, step S23, which is based on a signal of the courtesy SW 22 in the second embodiment (refer to FIG. 3A), may be included. Otherwise, steps S41 to S47 are substantially the same as steps S31 to S37 of the third embodiment.

In the present embodiment, when fully closing the window glass WG, which has been opened in an unexpected manner due to an erroneous entrapment determination (erroneous reversal of window glass WG) caused by an impact generated when the door DR is closed, the window glass WG is fully closed in cooperation with operation of the door lock SW 25, which locks the door DR. This eliminates the need for the driver or the like to operate the closing SW 20*b* again. The present embodiment also prevents the window glass WG from being left open when the driver or the like leaves the vehicle. The window glass WG is fully closed in the present embodiment as intended by the driver or the like.

The advantages of the present embodiment will now be described.

(1) The present embodiment has advantage (1) of the third embodiment.

(2) The present embodiment has advantage (2) of the third embodiment.

(3) If determination that entrapment has occurred entrapment is erroneous, full closing is started by operation of the door lock SW 25, which is remotely operated, to fully close the window glass WG that has been reversed to open. The full closing is performed as intended by the driver or the like. The full closing is performed in cooperation with the operation of the door lock without requiring the driver and the like to perform an additional operation.

Fifth Embodiment

A power window control device according to a fifth embodiment will now be described.

Figure 6:
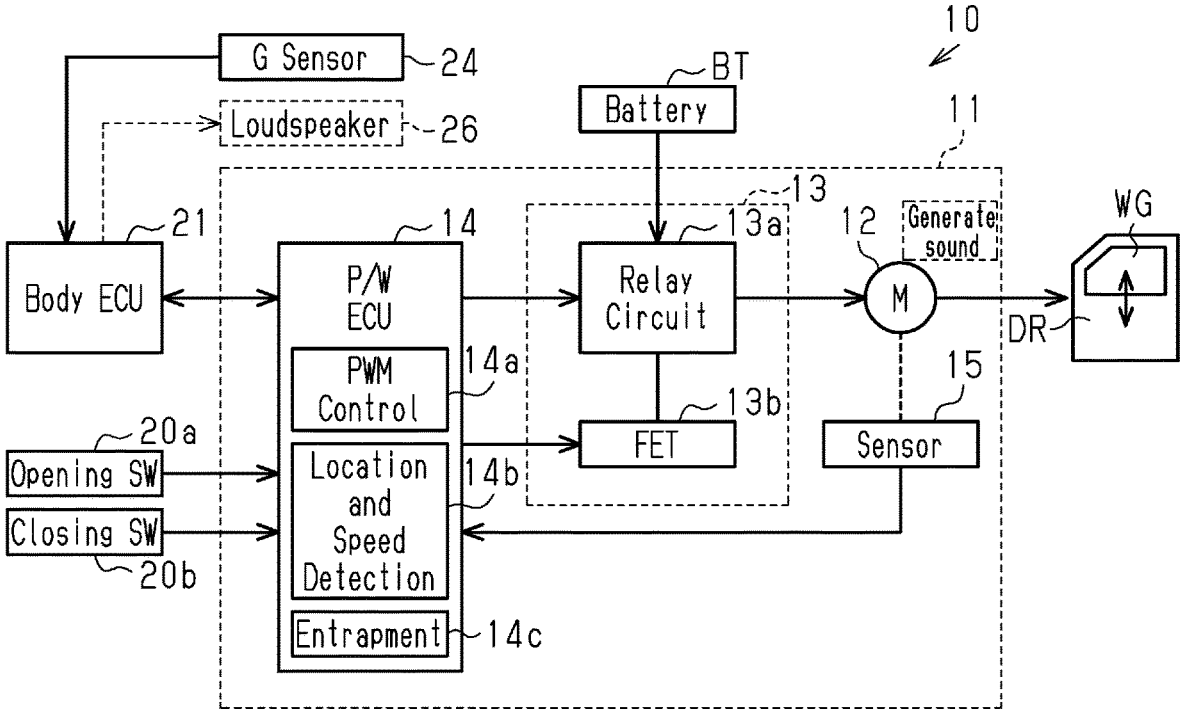
FIG. 6 is a schematic diagram showing the configuration of a power window system according to a fifth embodiment.
Figure 7A:
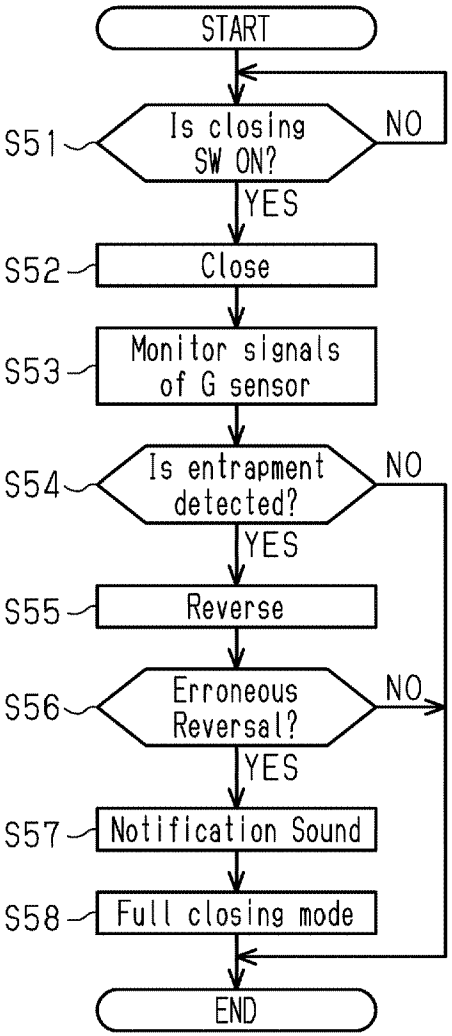
FIG. 7A is a flowchart showing a power window control mode according to the fifth embodiment.
Figure 7B:
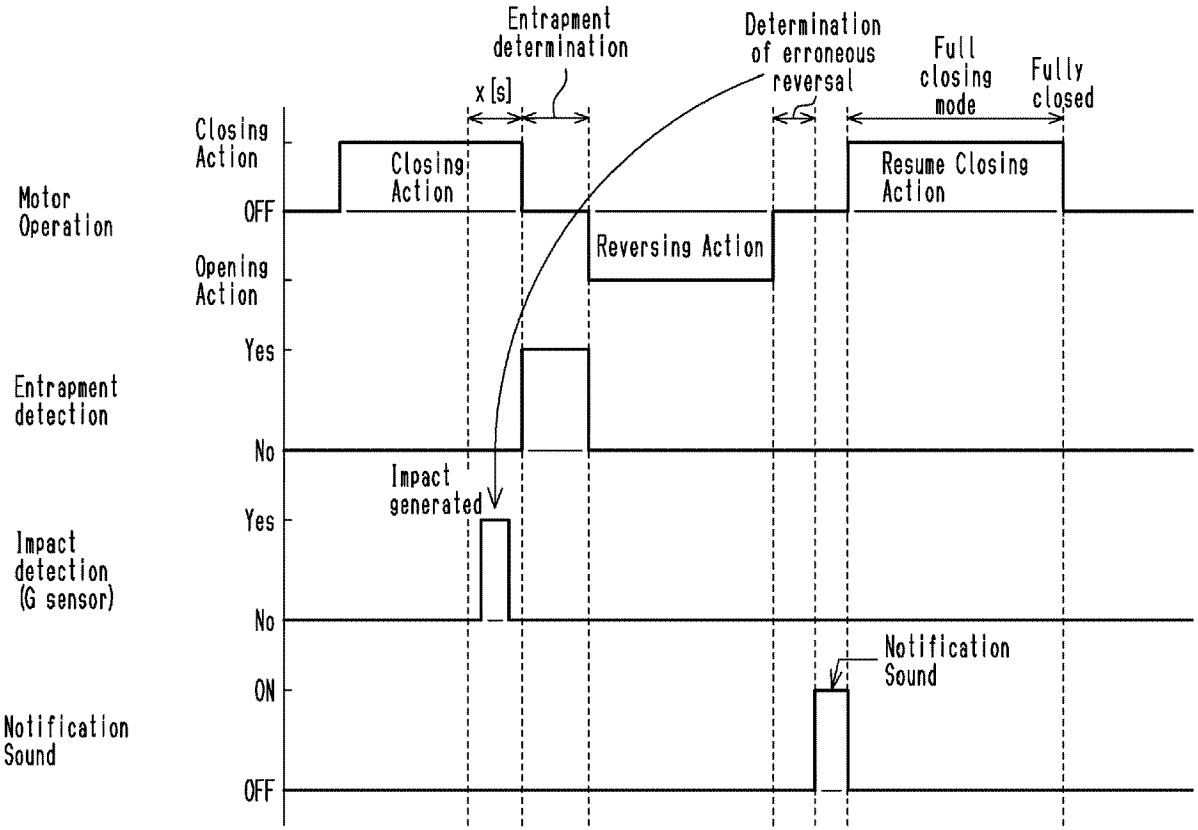
FIG. 7B is a timing chart of a power window control mode according to the fifth embodiment.

Control according to the present embodiment is applied to the power window system 10 shown in FIG. 6. The control is illustrated in detail in the flowchart of FIG. 7A and the timing chart of FIG. 7B. The control (steps S51 to S58) in the present embodiment uses the signal of the acceleration sensor (G sensor) 24 in the same manner as the third embodiment. The P/W ECU 14 in the present embodiment obtains the acceleration signal of the G sensor 24 and detects an impact generated when the vehicle door DR is closed (impact that affects entrapment determination).

The power window system 10 in the present embodiment is configured to execute control that generates a notification sound with the motor body 12 or generates a notification sound with a loudspeaker 26. Normal PWN control of the motor body 12 uses a control frequency in a non-audible band, for example, 20 kHz, and applies voltage in a range that allows for movement of the window glass WG to the motor body 12. When generating sound with the motor body 12, a control frequency in the audible range, for example, 1 kHz, and a small voltage that cannot move the window glass WG is applied to the motor body 12. This vibrates and generates sound with the motor body 12 without moving the window glass WG.

The process flow of the P/W ECU 14 in the present embodiment includes step S57 that generates a notification sound between step S56 that determines an erroneous reversal of the window glass WG based on an erroneous entrapment determination and step S58 that shifts the window glass WG to a full closing mode. The process in the third embodiment fully closes the window glass WG without issuing a notification sound. In the process of the present embodiment, after determining that the WG has been erroneously reversed, a notification sound is generated with the motor body 12 or the loudspeaker 26. Then, the window glass WG is fully closed. In this manner, the window glass WG is fully closed in the present embodiment after the driver or the like are notified of the full closing.

The advantages of the present embodiment will now be described.

(1) The present embodiment has advantage of (1) of the third embodiment.

(2) The present embodiment has advantage of (2) of the third embodiment.

(3) If determination that entrapment has occurred entrapment is erroneous, a notification sound is generated with the motor body 12 or the loudspeaker 26 before fully closing the window glass WG, which has been reversed and opened. This attracts the attention of the driver or the like. The use of the motor body 12 as a sound generation device eliminates the need for a separate device that generates sound. Further, the loudspeaker 26 is usually installed in a vehicle. This eliminates the need for a separate device that generates sound.

Sixth Embodiment

A power window control device according to a sixth embodiment will now be described.

Figure 8:
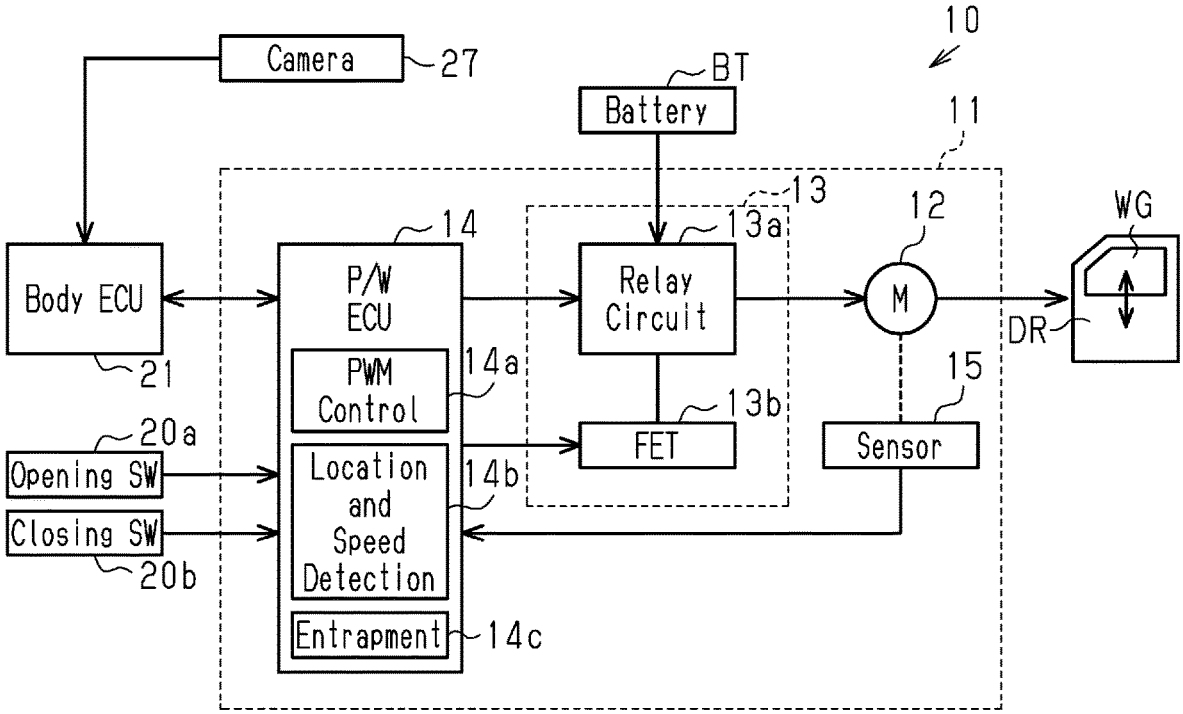
FIG. 8 is a schematic diagram showing the configuration of a power window system according to a sixth embodiment.
Figure 9A:
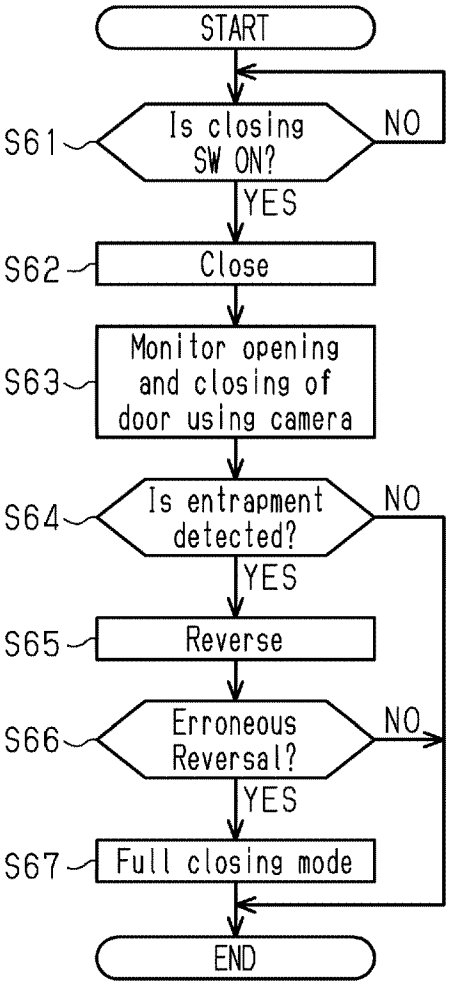
FIG. 9A is a flowchart showing a power window control mode according to the sixth embodiment.
Figure 9B:
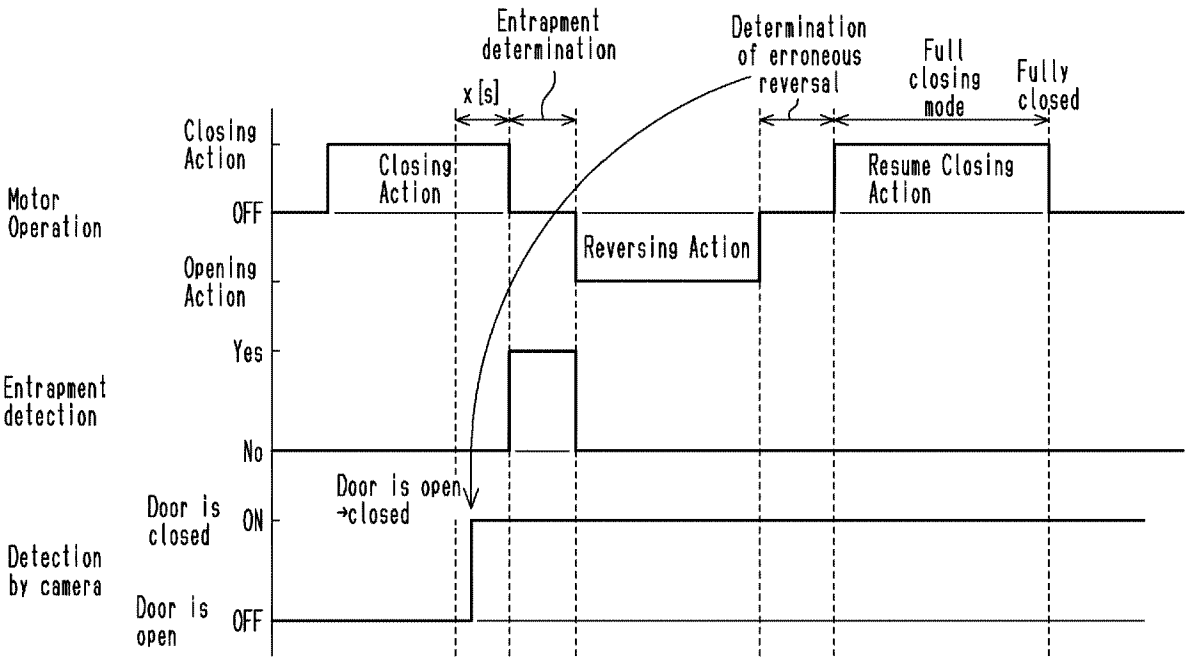
FIG. 9B is a timing chart of a power window control mode according to the sixth embodiment.

Control according to the present embodiment is applied to the power window system 10 shown in FIG. 8. The control is illustrated in detail in the flowchart of FIG. 9A and the timing chart of FIG. 9B. The control of the present embodiment differs from the second embodiment in that a signal of a camera 27 shown in FIG. 8 is used. The camera 27 captures images and detects the open and closed position of the vehicle door DR. The P/W ECU 14 in the present embodiment obtains a door opening and closing state signal from the camera 27 via the body ECU 21 to detect the open and closed position of the door DR.

In the process flow of the P/W ECU 14 in the present embodiment, steps S61 to S67 are substantially the same as steps S21 to S27 of the second embodiment except in that step S23 based on a signal of the courtesy SW 22 in the second embodiment (refer to FIG. 3A) is replaced by step S63 based on a signal of the camera 27 (monitoring of door opening and closing using camera 27). Specifically, the camera 27 is used as in the present embodiment so that the impact generated when the door DR is closed can be detected in the same manner as the courtesy SW 22 of the second embodiment. In step S66, the P/W ECU 14 determines whether it was determined in step S63 with the camera 27, which monitors the opening and closing of the door, that impact was generated by the closed door DR during time x[s] prior to the entrapment determination (in which effect of impact of closed door DR may result in erroneously entrapment determination) to determine whether the impact of the closed door DR resulted in erroneous entrapment determination and erroneous reversal of the window glass WG.

The present embodiment eliminates the need for the driver or the like to operate the closing SW 20*b* again to fully close the window glass WG that is opened in an unexpected manner due to an erroneous entrapment determination (erroneous reversal of window glass WG) caused by an impact generated when the door DR is closed. The present embodiment also prevents the window glass WG from being left open when the driver or the like leaves the vehicle.

The advantages of the present embodiment will now be described.

(1) The present embodiment has advantage of (1) of the second embodiment.

(2) This allows a simple configuration using the camera 27, which detects the open and closed position of the vehicle door DR, to detect erroneous entrapment determination caused by an impact when the door DR is closed.

The above-described embodiments may be modified as follows. The above-described embodiments and the following modifications can be combined as long as the combined modifications remain technically consistent with each other.

Signals of the courtesy SW 22, the G sensor 24, and the camera 27 are used to detect an impact when the door DR is closed. Instead, signals of other switches and sensors may be used. In this case, signals of switches and sensors that are usually installed in a vehicle may be used.

Signals of the IG SW 23 are used when the driver or the like leave the parked vehicle. Instead, signals of other switches and sensors may be used. In this case, signals of switches and sensors that are usually installed in a vehicle may be used.

Before the full closing, the motor body 12 or the loudspeaker 26 generates a notification sound. Instead, a notification sound may be generated during the full closing. Further, a notification sound may be generated before and during the full closing.

Although the window glass WG contains glass in its name, the window glass WG may also contain a material made of a resin other than glass.

The motor body 12 and the P/W ECU 14 that are integrally coupled may be separate members.

The configuration of the power window system 10 may be changed in addition to the above embodiments and variations The body ECU 21 and the P/W ECU 14 may be configured, for example, by circuitry, that is, at least one dedicated hardware circuit such as an application-specific integrated circuit (ASIC), at least one processing circuit that operates according to a computer program (software), or a combination of them. The processing circuit includes a CPU and memory (ROM, RAM, and the like), which store programs executed by the CPU. The memory, or computer-readable media, includes any type of media that is accessible by general-purpose computers and dedicated computers.

A technical concept that can be acknowledged from the above embodiments and modifications will now be described.

(A) A power window motor including a power window control device according to each claim and a motor body integrally coupled to the power window control device.

While the present disclosure is described with reference to examples, the present disclosure is not limited to the example or the configuration of the example. The present disclosure includes various variations and modifications within an equivalent range. In addition, various combinations and forms and other combinations and forms, which include only one element or more, shall be within the scope or a range of ideas of the present disclosure.

The invention claimed is:

1. A power window control device comprising an electronic control unit configured to:

control a motor to open and close a window glass of a vehicle door;

perform an entrapment prevention control process that makes a determination that a possibility that foreign material is entrapped by the window glass and reverses movement of the window glass from closing the window glass to opening the window glass when the electronic control unit determines, via the entrapment prevention control process, the possibility that foreign material entrapment has occurred;

determine, when the electronic control unit makes the determination, via the entrapment prevention control process, that the possibility that entrapment has occurred while the window glass is closing to fully close, whether the determination is caused by an impact generated when closing the vehicle door; and switch, when the electronic control unit determines that the determination is caused by the impact generated when closing the vehicle door, to a control for fully closing the window glass that has been reversed and opened.

2. The power window control device according to claim 1, wherein the electronic control unit is configured such that the electronic control unit determines whether the determination is caused by the impact generated when closing the vehicle door from at least one of a signal from a courtesy switch that detects an open and a closed position of the vehicle door and a signal from an acceleration sensor that detects acceleration of a vehicle that includes the power window control device in a predetermined direction.

3. The power window control device according to claim 1, wherein the electronic control unit is configured such that the electronic control unit determines whether the determination is caused by the impact generated when closing the vehicle door from a signal of a camera that detects an open and a closed position of the vehicle door.

4. The power window control device according to claim 1, wherein the electronic control unit is configured such that the electronic control unit determines whether the determination is caused by the impact generated when closing the vehicle when the window glass starts closing to fully close within a preset time from when an ignition switch is switched off.

5. The power window control device according to claim 1, wherein the electronic control unit is configured such that, when the electronic control unit determines that the determination is caused by the impact generated when closing the vehicle door, the electronic control unit automatically starts full closing to fully close the window glass that has been reversed and opened.

6. The power window control device according to claim 1, wherein the electronic control unit is configured such that, when the electronic control unit determines that the determination is caused by the impact generated when closing the vehicle door, the electronic control unit starts full closing in accordance with a lock instruction signal from a door lock switch that is remotely operated to fully close the window glass that has been reversed to open.

7. The power window control device according to claim 1, wherein the electronic control unit is configured such that, when the electronic control unit determines that the determination is caused by the impact generated when closing the vehicle door, the electronic control unit controls a sound generating device to generate a notification sound before or while fully closing the window glass that has been reversed and opened.

8. A power window control device configured to control a motor to open and close a window glass of a vehicle door, comprising:

a motor controller; and a processor that determines a possibility that foreign material is entrapped by the window glass;

wherein the power window control device is configured to:

reverse movement of the window glass from closing of the window glass to opening of the window glass when the processor determines the possibility that foreign material is entrapped by the window glass;

determine, when the processor determines the possibility that foreign material is entrapped by the window glass, whether the determination is caused by a closing of the vehicle door; and switch, when the power window control device determines that the determination is caused by the closing of the vehicle door, to a control for fully closing the window glass.

9. A power window control device comprising an electronic control unit configured to:

control a motor to open and close a window glass of a vehicle door, determine that foreign material is entrapped by the window glass and reverse movement of the window glass from closing the window glass to opening the window glass when the electronic control unit makes a determination that the foreign material is entrapped by the window glass;

determine, when the electronic control unit makes the determination that the foreign material is entrapped by the window glass while the window glass is closing to fully close, whether the determination is caused by an impact generated when closing the vehicle door; and switch, when the electronic control unit determines that the determination is caused by the impact generated when closing the vehicle door, to a control for fully closing the window glass that has been reversed and opened.

10. A vehicle door with a window glass and a power window control device comprising:

a motor configured to open and close the window glass; and an electronic control unit configured to:

control the motor to open and close the window glass;

determine that foreign material is entrapped by the window glass and reverse movement of the window glass from closing the window glass to opening the window glass when the electronic control unit makes a determination that the foreign material is entrapped by the window glass;

determine, when the electronic control unit makes the determination that the foreign material is entrapped by the window glass while the window glass is closing to fully close, whether the determination is caused by an impact generated when closing the vehicle door; and switch, when the electronic control unit determines that the determination is caused by the impact generated when closing the vehicle door, to a control for fully closing the window glass that has been reversed and opened.

* * * * *